United States Patent [19]

Ivanov et al.

[11] 4,453,703

[45] Jun. 12, 1984

[54] SINTERING MACHINE

[75] Inventors: Anatoly I. Ivanov, Donetsk; Igor A. Lokh, Zhdanov; Stanislav T. Pliskanovsky, Dnepropetrovsk; Boris G. Novikov, Zhdanov; Vitaly B. Fomin, Zhdanov; Nikolai M. Svinarenko, Zhdanov; Igor N. Krasavtsev; Tikhon T. Nesterenko, both of Donetsk; Alexandr D. Archikov, Makeevka; Evgeny A. Demidovich, Enakievo; Leonid F. Lukyanchenko, Donetsk; Nikolai D. Pryadko; Sergei G. Smerechinsky, both of Enakievo; Jury V. Oleinik, Donetsk, all of U.S.S.R.

[73] Assignee: Donetsky Politekhnichesky Institut, Donetsk, U.S.S.R.

[21] Appl. No.: 322,850

[22] Filed: Nov. 19, 1981

[51] Int. Cl.[3] ..... C21B 7/22; C22B 1/20

[52] U.S. Cl. ..... 266/157; 34/13; 34/20; 209/136; 209/154; 266/178; 432/16; 432/17; 432/77; 75/5

[58] Field of Search ..... 75/5; 209/136, 137, 209/154, 34, 35; 432/77, 78, 14, 16, 17; 34/13, 20; 266/178–180, 157

[56] References Cited

U.S. PATENT DOCUMENTS

| | | | |
|---|---|---|---|
| 2,375,487 | 5/1945 | Newhouse | 209/238 |
| 3,907,670 | 9/1975 | Fernandes | 209/137 |

FOREIGN PATENT DOCUMENTS

| | | | |
|---|---|---|---|
| 1096296 | 12/1967 | United Kingdom | 75/5 |
| 1574593 | 9/1980 | United Kingdom | 75/5 |
| 250060 | 12/1969 | U.S.S.R. | 209/136 |
| 473532 | 6/1975 | U.S.S.R. . | |
| 608568 | 5/1978 | U.S.S.R. | 209/136 |

OTHER PUBLICATIONS

Transactions of the Iron & Steel Institute of Japan–vol. 14, #3, 1974, pp. 208–216, (In English).

*Primary Examiner*—Michael L. Lewis
*Attorney, Agent, or Firm*—Murray Schaffer

[57] ABSTRACT

The invention comprises a sinter belt and a collector, vacuum chambers, a gas cleaning device, an air purifying device, and an exhauster mounted adjacent the belt. Above the sinter belt are mounted assemblies for loading a bed and a charge, and an ignition hearth. Downstream from the sinter belt are mounted a sinter breaker and an inclined chute wherein are mounted vibrating screens communicating with a cooler for a sinter return and for the bed, and an air classifier. The air classifier comprises a fan, a diffuser, a movable grid for varying the speed of the air produced by the fan, and a partition member forming a settling chamber together with the chute. Within the settling chamber is mounted a device for settling coarse fines, said device communicating with the collector through the air purifying device, and with the cooler for the sinter return.

3 Claims, 4 Drawing Figures

SINTERING MACHINE

BACKGROUND OF THE INVENTION

1. Field of the Invention

The invention relates to the art of ferrous metallurgy, and namely to the design of a sintering machine, and is employed for making a sinter for blast furnaces, said sinter containing not more than 0.2 to 0.3% fines ranging in size from 5 to 0 mm.

The fines ranging in size from 5 to 0 mm, contained in the sinter, exert an influence upon gas dynamic resistance of a column of charge materials of the blast furnace, said resistance in turn influencing coke consumption and capacity of the blast furnace.

2. Prior Art

The quality of the sinter depends on a type of a sorting device employed in the sintering machine.

To sort the sinter in accordance with its size, it is possible to apply stationary bar screens, air classifiers, and vibrating screens.

Stationary bar screens have a low capacity caused by clogging slots of the bar field and by reducing the working area of the screen.

Prior art air classifiers are also characterized by a low capacity and by large overall dimensions, which features prevent their application in sintering machines since such an application would cause creation of a bulky sorting complex.

Known in the art is an air classifier (USSR Author's Certificate No. 473,532) comprising a frame, a receiving tray supported by a stationary shaft and a return spring, a system of levers, a diffuser, branch pipes provided with a movable wall member and a stationary wall member, said wall members forming slots whose profile is made in accordance with the Laval nozzle, a separation chamber provided with funnels for coarse and fine material, and a fan. Within the separation chamber there is mounted a distributor receiving device, a rotary partition member disposed between the funnels, and a device for purifying the air supplied to the fan from dust.

The above air classifier operates as follows.

A material to be classified is fed along the receiving tray to the distributor receiving device and thence into the zone of the separation chamber where the diffuser is disposed.

Under the action of a jet of the air being forced by the fan through the diffuser there occurs separation of the material into a fine fraction and a coarse fraction. The coarse fraction of the material flows into a funnel disposed close to the diffuser, while the fine fraction flows into the next funnel.

Ingress of the coarse fraction of the material into the funnel designed for the fine fraction is prevented by a rotary partition member mounted between the funnels, the size of openings provided in the partition member being less than that of the coarse fraction.

From the separation chamber the air is sucked by the fan through the device for purifying the air and is again directed into the diffuser.

In the case of variation of feed loading, the receiving tray rotates about the stationary shaft and, by means of the system of levers and the return spring, shifts the movable wall members of the branch pipes to or from the stationary wall member, thereby increasing or reducing a space provided therebetween. As a result, the speed of the air jet directed to the material to be separated is either increased or reduced. A required jet speed at a minimum air consumption is ensured due to a profile of the slot through which the air is passing, said slot having the form of the Laval nozzle.

The above described air classifier has a low effectiveness of classification of the material and a low carrying capcity, caused by inertia of the "receiving tray-branch pipes" system, and by the distributing device which does not influence the magnitude of the flow of a material being supplied therethrough into the separation chamber.

Thus, as the load on the receiving tray increases, the air speed also increases, while the material flow remains the same, since this flow is limited by the distributing device. The above fact results in an overblow, i.e. occurence of coarse particles within the funnel for the fine material. On the contrary, when the load on the receiving tray reduces, the air speed is too low to carry out the process, and the distributing device still distributes the material for some time into the separation chamber at the previous speed, thereby resulting in an underblow, i.e. fine particles appear within the funnel for the coarse material.

The air purifying device is also ineffective since it reduces the flow section of the separation chamber. The air speed increases sharply, thereby leading to entrainment of dust and to supply of this dust into the fan instead of settling it down. A closed system for feeding and removing the air results in accumulation of dust therewithin, in ejection of this dust into the atmosphere, and in rapid damage of the pipelines for feeding and removing the air due to high abrasive properties of said dust.

The slope of the rotary partition member is not adjusted with the variation of load on the receiving tray, which results in that the fine fraction gets into the coarse one.

In vibration screening, separation of fines ranging in size from 5 to 0 mm from the sinter is accomplished mainly in the lower layer of the sinter contacting directly with a bar screen, therefore the process of classification of the sinter should be carried out on several vibrating screens.

Moreover, the removal of fines from the sinter is impeded by the surface structure of coarse bits of sinter, which is characterized by the presence of extremely developed channels and macropores, wherein lie dust particles, fines and fragments.

The closest to the design of the present invention is a sintering machine (Kawamura Minour, Hasegawa Akira, Kawabe Masaguni, Koseya Shoichi, "Trans. Iron and Steel Inst. Jap.", 1974, 14, No. 3, pp. 208–216), comprising an assembly for loading a bed, an assembly for loading a charge, an ignition hearth, a sinter belt, an exhauster, a sinter breaker, an inclined chute, an air purifying device, a gas cleaning device, a system for cooling a sinter return and the bed, a collector, and a system for sorting the sinter, consisting of five vibrating screens mounted in series in a first row and in a second reserve row.

Laying a bed layer onto the sinter belt is ensured by the assembly for loading the bed, following which the charge is supplied thereover by the assmebly for loading the charge, said charge being ignited by the ignition hearth and subjected to sintering by sucking the air through the charge layer containing a fuel. The sinter thus obtained is crushed by the sinter breaker and is directed by the inclined chute to vibrating screens where separation of the sinter into a return and a suitable sinter takes place, both said fractions being cooled within the system for cooling the return and the sinter coolers respectively. The collector provides for removal, by means of the exhauster, of process gases from the layer being sintered into the gas cleaning device.

The above sintering machine makes it possible to obtain a sinter containing not more than 4 to 5% fines ranging in size from 5 to 0 mm, which is the world best index for quality of sinter. It should be noted, however, that the above sintering machine is excessively complicated and bulky since the total area of screens being utilized has reached 190 $m^2$ as against 10 to 15 $m^2$ when applying a conventional production process. Moreover, an increase in the number of sorting devices results in augmentation of material and labour consumption for their repair, service and use.

Residual content of fines ranging in size from 5 to 0 mm, which constitutes 4 to 5%, can be explained by deposition of dust particles and fragments within winding channels and macropores which are present in a sinter lump. Being of a small mass, these particles are easily transported by a coarse lump and do not participate in the process of sorting. For this reason, a further increase in the number of vibrating screens involved in the process of sorting the sinter will not result in decreasing the content of fines.

SUMMARY OF THE INVENTION

The main object of the invention is the provision of a sintering machine wherein a classifier for separating a sinter is so constructed that it allows to simplify the design of the sintering machine, to increase its capacity and to improve the quality of separation of the sinter to be upgraded.

The objects set forth and other objects of the invention are attained by providing a sinter belt and assemblies for loading a bed and a charge, and an ignition hearth mounted above the sinter belt, vacuum chambers, a collector, a gas cleaning device, an air purifying device, an exhauster mounted under the sinter belt and being in communication with each other, a sinter breaker, a chute, vibrating screens, and coolers for a sinter return and for the bed mounted behind the sinter belt. According to the invention, downstream from the sinter breaker there is mounted an air classifier comprising a fan, a diffuser communicating with it and a movable grid for varying the speed of air being forced by the fan, the grid being mounted within the chute and operatively connected with a partition member mounted within the chute in front of the movable grid and forming a settling chamber together with the chute, in which chamber is mounted a device for settling coarse fines communicating with the collector through the air purifying device and with the cooler for the sinter return.

Such an arrangement of the sintering machine considerably simplifies its design, increases capacity of the machine, and upgrades the quality of separation of the sinter.

Simplifying the design of the sintering machine is achieved by decreasing the number of vibrating screens and accomplishing reliable separation of the sinter by the air classifier being of small dimensions.

This in turn allows rather great production areas to be freed.

The capacity of the sintering machine increases due to the increase in the amount of the sinter return separated by the air classifier from the sinter, and due to the suply thereof to the sinter belt into the charge.

The above fact results in coarsening of the granulometric composition of the charge, thereby increasing gas impermeability thereof, and consequently accelerates the process of sintering the sinter.

Upgrading the quality of separation of the sinter is achieved through a more effective removal of fines ranging in size from 5 to 0 mm, which removal is accomplished by the air classifier. Residual content of fines having the above sizes does not exceed 0.2 to 0.3% abs.

In accordance with the invention, it is expedient to provide a movable grid for varying the speed of air being forced by the fan in the form of a frame having an upper base and a lower base, and shafts mounted therebetween and having rotary plates disposed thereon, an upper link and a lower link mounted in perpendicular relationship with the shafts, the rotary plates being alternately secured to the upper link and the lower link, which in turn are secured to the chute.

The rotary plates of the air classifier create an air flow possessing a large kinematic energy, which flow blows through the whole layer of sinter and ensures an intensive agitation of the above layer, therby resulting in complete separation of fines ranging in size from 5 to 0 mm from the total flow of sinter into the settling chamber.

Moreover, in the case of variation of loading on the movable grid, there is automatically provided variation in the speed of air being forced by the fan, thereby allowing practically all fines ranging in the size from 5 to 0 mm to be removed from the flow of sinter.

The air flow produced by the air classifier cools the sinter and prevents buckling of the chute of the sintering machine.

In accordance with the invention, it is desirable to mount the movable grid for varying the speed of air being forced by the fan, on a telescopic support and guides provided with sliders operatively connected with the partition member.

Such an arrangement makes it possible to adjust the movable grid depending on the loading on this grid, which in turn ensures the ability of regulating an air flow passing through the grid.

Moreover, the slope of the partition member is adjusted depending upon the variation of loading on the movable grid and shifting thereof, thereby providing for reliable separation of fines ranging in size from 5 to 0 mm from the sinter.

In accordance with the invention, it is necessary to provide a device for settling coarse fines in the form of pipes disposed above the partition member, the horizontal distance between the pipes decreasing as the pipes approach the partition member, a lower row of the pipes being mounted with respect to the base of the partition member at a height being of 0.6 to 0.7 of that of the partition member.

Such an arrangement provides for reducing the speed of both coarse and dust particles constituting fines ranging in size from 5 to 0 mm, and for removing same into the settling chamber and thence into the cooler for the return.

Settling dust particles is facilitated due to reduction of speed of air in the direction from the movable grid through an increase in the distance between the pipes.

BRIEF DESCRIPTION OF DRAWINGS

The above-mentioned objects and other objects of the present invention will be best understood by reference to the following description of an embodiment of the invention taken in conjunction with the accompanying drawings, wherein.

DESCRIPTION OF PREFERRED EMBODIMENT

Figure 1:
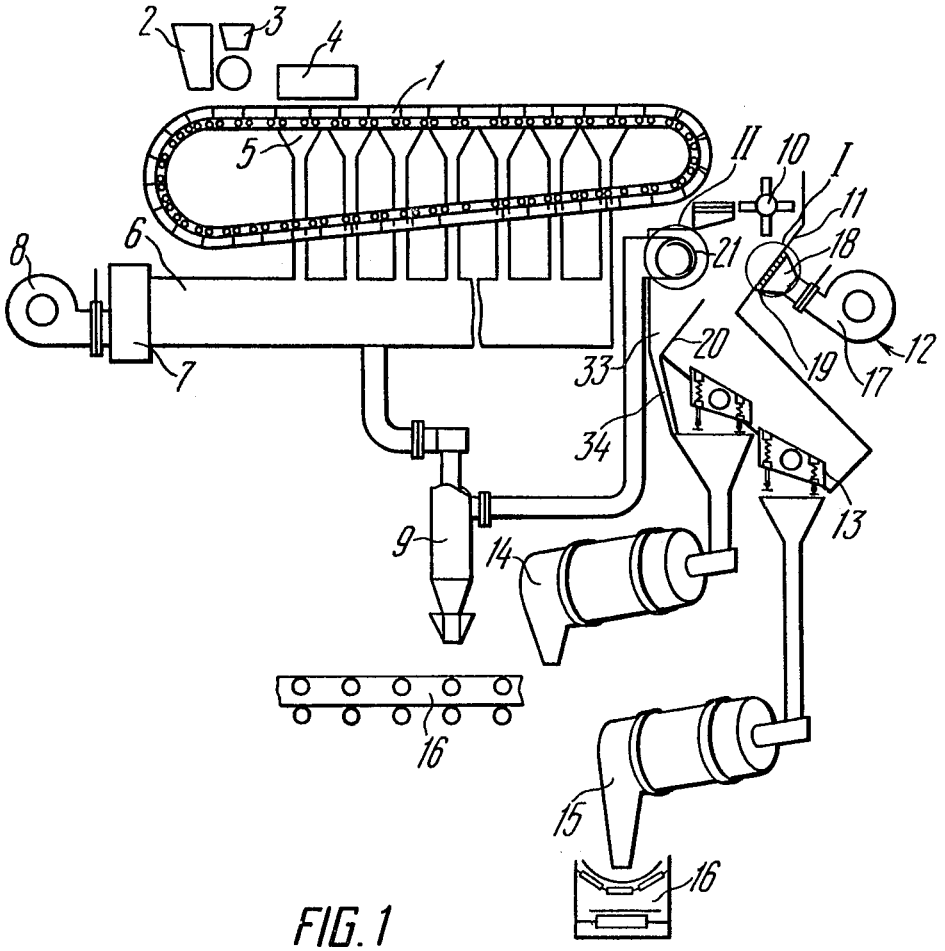
FIG. 1 shows schematically the sintering machine of the invention.

The sintering machine comprises a sinter belt 1 (FIG. 1), above which is disposed in series an assembly 2 for loading a bed onto the sinter belt 1, an assembly 3 for loading a charge over the bed, an ignition hearth 4 for ingiting the charge. Below the working run of the sinter belt 1 are mounted vacuum chambers 5, a collector 6, a gas cleaning device 7, an exhauster 8, and a device 9 for purifying air from dust.

Behind the sinter belt 1 is mounted a breaker 10 and an inclined chute 11 disposed thereunder, an air classifier 12, two vibrating screens 13 under which are mounted a cooler 14 for a return, a cooler 15 for the bed and conveyors 16 for transporting the return and the bed.

Figure 2:
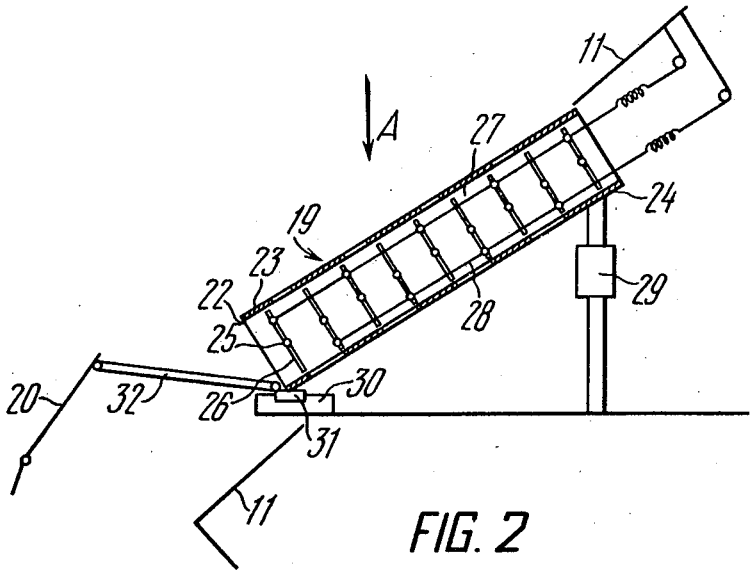
FIG. 2 shows an enlarged view of the assembly I shown in FIG. 1, according to the invention.
Figure 3:
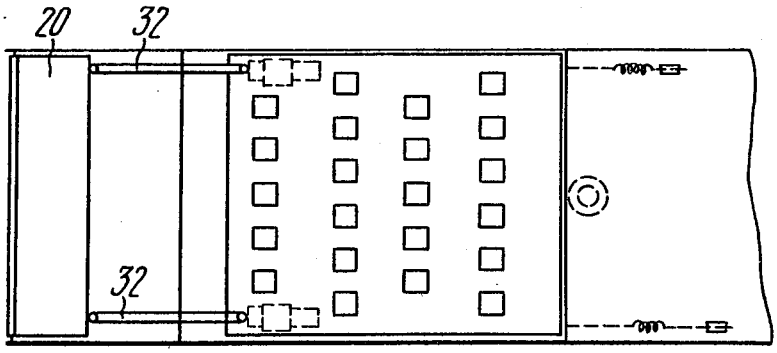
FIG. 3 shows a view taken along the arrow A in FIG. 2.

The air classifier 12 comprises a fan 17, a diffuser 18, a movable grid 19 (FIG. 2) for varying the speed of air being forced by the fan 17, the above members being disposed under the chute 11 within the zone of the breaker 10, a partition member 20, and a device 21 for settling coarse fines of sinter.

The movable grid 19 of the air classifier 12 is built into the wall of the chute 11 and comprises a frame 22 provided with an upper base 23 and a lower base 24, shafts 25 being mounted therebetween in parallel relationship thereto, and rotatory plates 26 mounted on said shafts.

An upper link 27 is mounted in perpendicular relationship with the shafts 25 under the upper base 23 of the frame 22, while a lower link 28 is mounted above the lower base 24. The rotatory plates 26 are alternately secured to the upper link 27 and the lower link 28, which in turn are secured to the wall of the chute 11.

One end of the frame 22 of the movable grid 19 is supported by a telescopic support 29, while the other end thereof is supported by guides 30 provided with sliders 31 being connected with the partition member 20 by means of a rod 32.

The partition member 20 of the air classifier 12 is mounted within the inclined chute 11 in front of the vibrating screens 13, forming a settling chamber 33 together with the walls of the inclined chute 11.

The settling chamber 33 is connected by a pipeline 34 with the cooler 14 for a return, which is mounted under the first vibrating screen 13.

Figure 4:
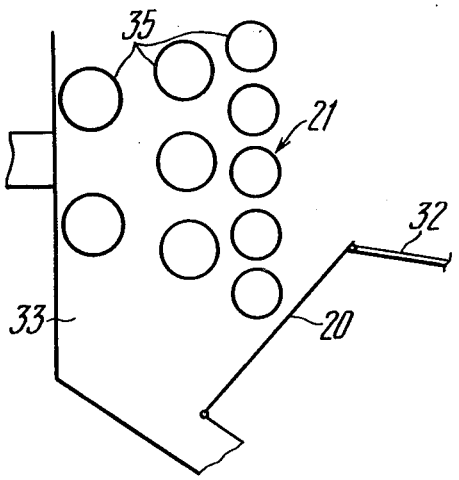
FIG. 4 shows an enlarged view of the assembly II shown in FIG. 1, according to the invention.

Within the settling chamber 33 above the partition member 20 is mounted the device 21 (FIG. 4) for settling coarse fines, which is connected with the collector 6 through the device 9 for purifying air.

The device 21 for settling coarse fines is constructed from pipes 35, the horizontal distance between the pipes reducing as they approach the partition member 20.

A lower row of the pipes 35 is mounted at a distance from the base of the partition member 20, of 0.6 to 0.7 of the height thereof.

The sintering machine operates as follows.

A bed and a charge are supplied to the moving sinter belt 1 by means of the assemblies 2, 3 for loading the bed and the charge. The charge containing a fuel is ignited by means of the ignition hearth 4, the air being sucked therethrough by the exhauster 8. Process gases are removed from the vacuum chambers 5 by means of the exhauster 8 into the collector 6 and thence through the gas cleaning device 7 into a smoke stock.

A sintered material is discharged from the sinter belt 1 into the breaker 10, crushed, screened with separation of the return and the bed, and discharged into a car.

In the course of passage through the movable grid 19 of the air classifier 12, the crushed sinter is subjected to blowing with the air being forced by the fan 17 through the diffuser 18.

The air carries fines out from the flow of sinter beyond the partition member 20 and into the settling chamber 33, in which chamber said fines are settled by the device 21 for settling coarse fines and supplied by the pipeline 34 into the cooler 14 for the return, mounted under the first vibrating screen 13, and thence onto the conveyor 16 for the return.

The pipes 35 of the device 21 for settling coarse fines reduce the speed of coarse particles and ensure smooth reduction of speed of dust-laden air in the direction from the movable grid 19 due to decrease in the aerodynamic drag of the rows of pipes 35 in the same direction.

Exhaust, dust-laden air is fed to the device 9 for purifying air and is then discharged therefrom into the collector 6 of the sintering machine, while collected dust is removed by the conveyor 16 for the return.

Air classification of the sinter simplifies the design of the sintering machine and, due to an increase in the amount of the return getting into the charge, said increase causing upgrading gas permeability and accelerating the process of charge sintering, increases the capacity of the sintering machine.

In the case of variation of loading on the movable grid 19 the latter is shifted along the guides 30 by means of the sliders 31 which deflect the partition member 20 by means of the rods 32. Simultaneously with the shift of the movable grid 19, the links 27, 28 turn the rotary plates 26 about the shaft 25 to an angle proportional to the magnitude of the shift of the grid 19.

Spaces between the rotary plates 26 and the speed of the air being forced by the fan are changing, thereby providing for a more thorough blow of fines from the sinter.

What we claim is:

1. A sintering machine, comprising:

having an upstream and a downstream end, a sinter belt;

vacuum chambers disposed under said sinter belt, an assembly for loading a bed onto said sinter belt, mounted above said sinter belt at the upstream end;

an assembly for loading a charge onto said sinter belt, mounted downstream of said assembly for loading the bed;

an ignition hearth for igniting a charge, mounted downstream of said assembly for loading the charge;

a breaker for crushing sinter, mounted at the downstream end of said sinter belt;

a chute for discharging sinter, mounted beneath said breaker;

an air classifier within said chute for separating coarse fines from the sinter, comprising:

a fan mounted outside said chute;

a diffuser communicating with said fan, mounted outside the chute; and, a movable grid located within said chute for varying speed of the air flow within said chute; to selectively determine the separation of fine and coarse sinter;

a movable partition operatively connected with said movable grid and mounted with said chute in front of said grid defining a settling chamber with a variable opening for fines of coarse sinter;

means for settling coarse fines, mounted within said settling chamber comprising:

first and second vibrating screens for separating a return and a bed respectively from the sinter;

a cooler for the return, mounted under the first vibrating screen and communicating with said settling chamber;

a cooler for the bed, mounted under the second vibrating screen;

a collector for removing process gases, mounted under said sinter belt;

a gas cleaning device for cleaning process gases, communicating with said collector;

an exhauster for sucking air through a layer of the charge being sintered, communicating with said gas cleaning device; and a means for purifying air from the dust located downstream from said air classifier and communicating with said collector and with said device for settling coarse fines.

2. The machine as claimed in claim 1, in which said movable grid for varying the speed of the air produced by said fan comprises a frame having an upper base and a lower base, and a plurality of shafts mounted therebetween, rotary plates disposed on each of said shafts, an upper link and a lower link both mounted in perpendicular relationship with said shafts, said rotary plates being alternately secured to said upper link and said lower link, which in turn are secured to said chute.

3. The machine as claimed in claim 1, in which said movable grid for varying the speed of the air forced by the fan is mounted on a telescopic support and on guides provided with sliders operatively connected with said partition member.

* * * * *